US005467916A

United States Patent [19]

Beales

[11] Patent Number: 5,467,916

[45] Date of Patent: Nov. 21, 1995

[54] PAPERBOARD BOX WITH LOCKING TAB

[75] Inventor: Jonathan T. Beales, Memphis, Tenn.

[73] Assignee: International Paper Company, Purchase, N.Y.

[21] Appl. No.: 261,280

[22] Filed: Jun. 16, 1994

[51] Int. Cl.[6] ..... B65D 5/30

[52] U.S. Cl. ..... 229/195; 229/117.07; 229/125.29

[58] Field of Search ..... 229/117.01, 117.07, 229/125.29, 190, 195, 197, 125.28, 149, 150

[56] References Cited

U.S. PATENT DOCUMENTS

| | | | |
|---|---|---|---|
| 225,013 | 3/1880 | Knobeloch . | |
| 738,516 | 9/1903 | Beers . | |
| 1,470,141 | 10/1923 | Bryson . | |
| 1,611,029 | 12/1926 | Hedstrom . | |
| 1,681,700 | 8/1928 | Folmer . | |
| 1,827,029 | 10/1931 | Marcalus . | |
| 2,162,089 | 6/1939 | Kagen . | |
| 2,210,707 | 8/1940 | Chally . | |
| 2,243,825 | 5/1941 | Holtkamp | 229/117.07 X |
| 2,319,371 | 5/1943 | Stonecypher | 229/117.07 |
| 2,365,863 | 12/1944 | Cantor . | |
| 2,531,507 | 11/1950 | Goodyear . | |
| 2,702,153 | 2/1955 | Van Rosen | 229/117.07 |
| 3,095,136 | 6/1963 | Conescu | 229/117.07 X |
| 3,107,040 | 10/1963 | Ullger | 229/117.07 |
| 4,793,546 | 12/1988 | Nunn | 229/125.29 X |
| 5,226,587 | 7/1993 | Eisman et al. | 229/125.29 X |

FOREIGN PATENT DOCUMENTS

| | | | |
|---|---|---|---|
| 641292 | 6/1962 | Italy | 229/125.29 |

*Primary Examiner*—Allan N. Shoap
*Assistant Examiner*—Christopher McDonald
*Attorney, Agent, or Firm*—Michael J. Doyle

[57] ABSTRACT

A collapsible container is fashioned from a unitary blank of paperboard. The container is in the general form of a lower and truncated tray having a top closure lid hingedly secured to the top of the rear wall of the tray. After glueing of the lower tray, the tray is collapsed by bowing its side walls inwardly so that the entire tray may assume a substantially flattened configuration. The flattened container may then be shipped to a retail establishment, such as a fast food outlet, for subsequent set up or erection by merely unfolding the tray and pushing its sidewalls outwardly. In order to overcome the natural tendency of the sidewalls to resume their inwardly bowed configuration, having been stored in this shape for, typically, a substantial length of time, the sidewalls are provided with a novel latching slit and corner tab configuration which maintains the sidewalls in their desired substantially planar form. The container also exhibits a novel top latching arrangement wherein a latching tongue may be inserted into a complementary latching recess in either of two different ways.

8 Claims, 3 Drawing Sheets

PAPERBOARD BOX WITH LOCKING TAB

BACKGROUND OF THE INVENTION

This invention relates to collapsible containers and more particularly to a container fashioned from a unitary blank of paperboard.

Collapsible containers having a hinged top lid are known, such as shown in U.S. Pat. No. 3,107,040 issued to Ullger. Collapsible containers of this type are particularly useful because of their ability to be collapsed and stored prior to retail use, as well as their relative ease of erection or set up. After erection from a stored, collapsed configuration it is desired that the container sidewalls be straight.

SUMMARY OF THE INVENTION

According to the practice of this invention the side walls of a collapsible container are each provided with a semicircular cut and a novel latching tip construction which permits the side walls to maintain a desired planar shape upon final set up or erection from a collapsed, stored configuration. After being unfolded from a collapsed configuration, the paperboard side walls tend to bow inwardly, back to their collapsed form. Further according to the practice of this invention, a novel front latching tab and recess is employed which permits the container top to be latched in a closed position in either one of two ways. The container is of right pyramidal truncated shape to permit easy product loading and removal.

DETAILED DESCRIPTION OF THE INVENTION

Figure 1:
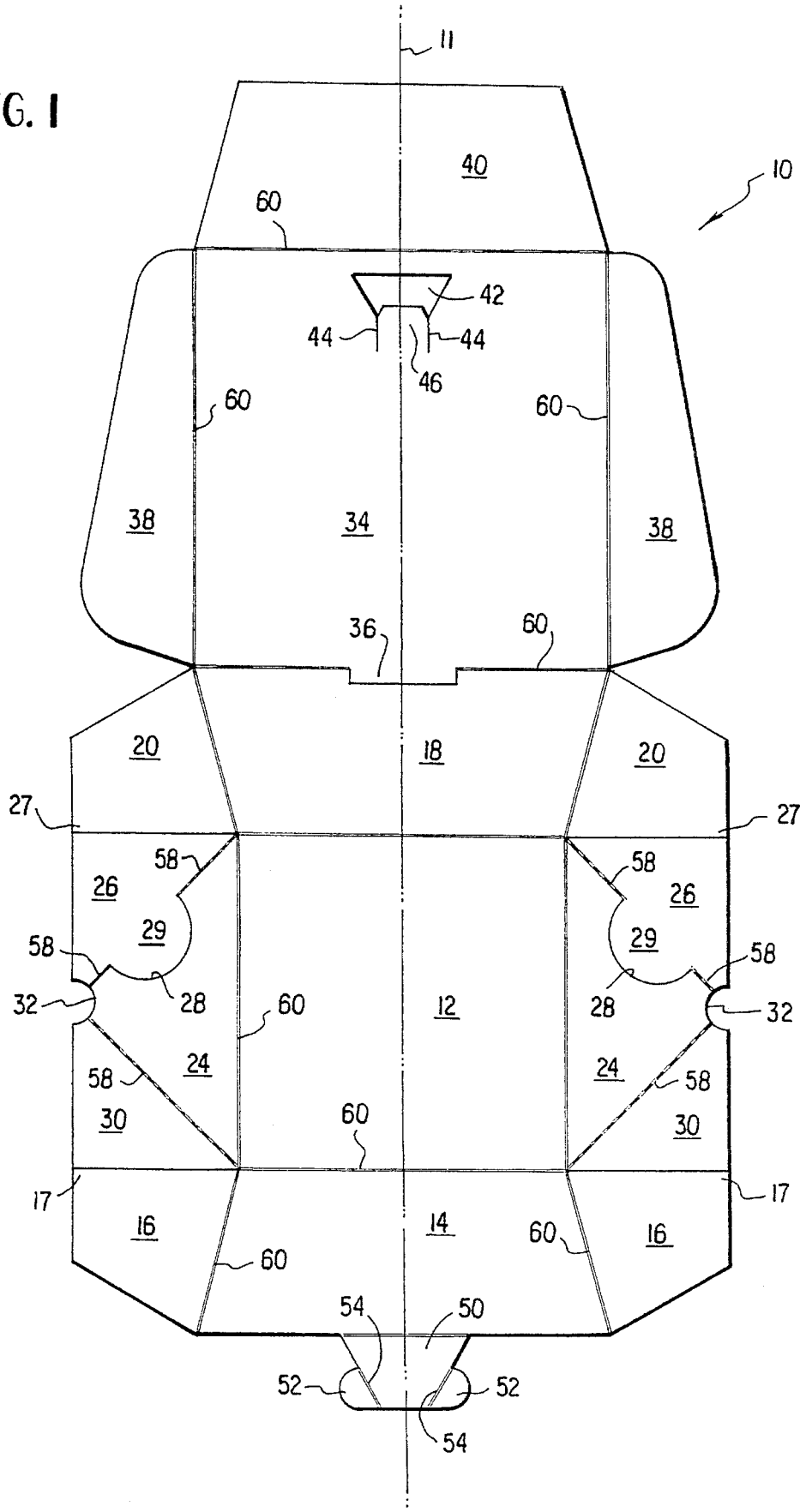
FIG. 1 is a plan view of a unitary blank of paperboard or other stiff, resilient, and foldable sheet material which is folded and glued to assemble the container of this invention.

Referring now to FIG. 1, the numeral 10 denotes generally a unitary blank of paperboard for forming the collapsible container of this invention. An imaginary vertical longitudinal axis 11 divides right and left halves of the blank into mirror symmetrical portions. The blank includes a tray bottom forming panel 12 and a lower trapezoidal and tray front wall forming panel 14 foldably secured to the lower edge (as viewed at FIG. 1) of panel 12. Lower lateral glue flaps or panels 16 are foldably secured to respective left and right edges of panel 14. Upper trapezoidal and tray rear wall forming panel 18 is foldably secured to the top edge of panel 12, with upper lateral glue flaps or panels 20 foldably joined to respective left and right edges of panel 18.

Generally square top lid closure forming panel 34 is bordered on its left and right edges by respective foldable side flaps 38. The lower portion of panel 34 is foldably secured to the top of panel 18, except at a central cut portion designated as 36. A lid top closure front closure flap 40 is foldably secured to the upper edge of panel 34.

The upper central portion of panel 34 is provided with a truncated triangular opening 42, with spaced, parallel cut lines 44 defining a tongue 46 whose tip extends into opening 42. These elements define one portion of 16 top lid latching arrangement.

The lower central portion of panel 14 is provided with an extension or latching flap 50, of generally trapezoidal form, with the lower side portions of flap 50 having respective lateral tabs 52 secured to flap 50 by respective fold lines 54. Elements 50–54 define the other portion of the top lid latching arrangement.

Right and left edges of tray bottom forming panel 12 are provided with generally triangular panels 24, with the hypotenuse of each being foldably secured to respective left and right edges of panel 12. Generally triangular panels 26 and 30 are secured by fold lines 58 to respective panels 24. Each panel 26, in turn, is provided with a semicircular cut 28 to form a respective tab 29. Semicircular cuts 32 are provided on the right and left edges of the lower portion of the blank. Tray sidewall latching elements or tips are designated as 27 in respective ninety degree corners of respective panels 20. Tips 17 of glue flaps 16 correspond to tips 27 of glue flaps or panels 20. Fold lines are designated as 60, with solid lines between some of the panels indicating cuts completely through the paperboard. Upper lid forming portion 34 is foldably joined to the lower blank portion 18, 12, 14 by fold line 60 along cut 36.

Figure 2:
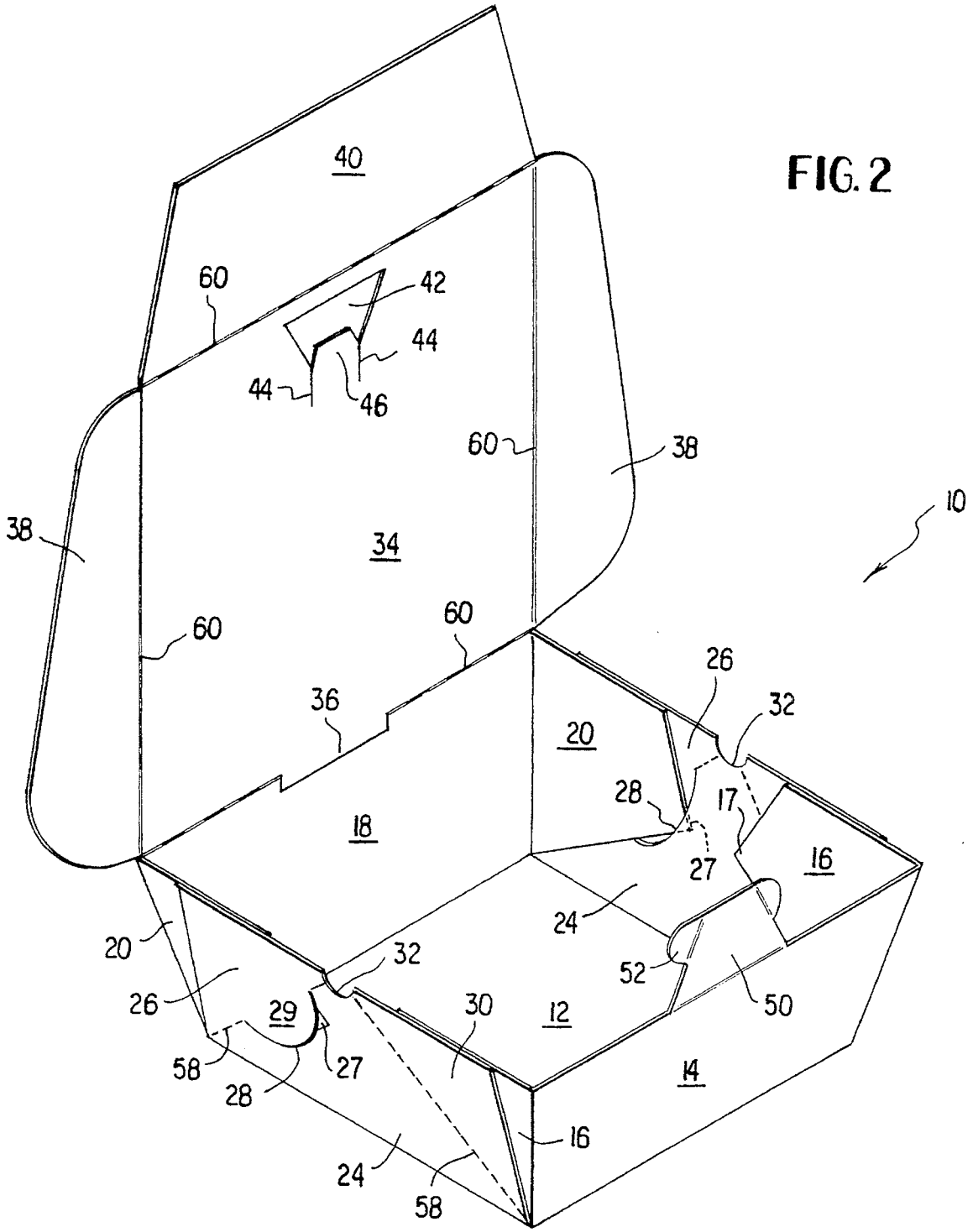
FIG. 2 is a perspective view showing the blank of FIG. 1 as folded and glued so as to fold a generally truncated bottom tray having a top cover hinged to one portion of the bottom tray.

Referring now to FIG. 2 of the drawings, the bottom tray forming panels have been folded and glue flaps 16 and 20 glued to respective triangular panels 30 and 26 form a tray, shown at the lower portion of FIG. 2. Respective left and right panel faces 20, 26 and 16, 30 are glued in surface contact to each other. The glueing operation and panel configuration is such that respective tips 27 are not glued to respective panels 26. The side walls of the tray, just prior to its illustrated fully erected tray configuration, are bowed inwardly to their collapsed form or condition by folding about fold lines 58, with tips 27 extending beyond fold spaced colinear fold lines 58.

Figure 3:
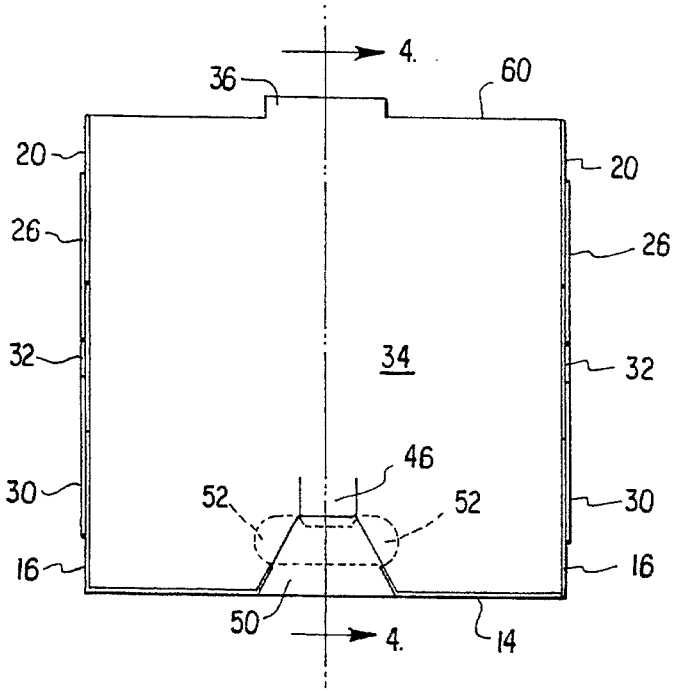
FIG. 3 is a top plan view of the container, after the top cover of FIG. 2 has been folded down into the horizontal position.

For tray erection, these inwardly bowing or canting side walls are pushed outwardly until tip 27 of each upper lateral panel 20 (located interiorly of its respective side wall) deforms and passes across a respective curved edge 28 of a respective triangular panel 24. Such tip deformation may be assisted by pushing with a finger tip. Tabs 29 are deformed outwardly upon such movement. This is shown at FIG. 2 wherein corner or tip 27 nearest the reader has passed from the inside of the container so as to lie on the outside sidewall nearest the reader. Similarly, farthest corner 27 has passed from the inside of the tray and now lies on the outside of the sidewall most remote from the reader. This latching precludes the side walls from bowing or bending inwardly, back towards their collapsed configuration due to the resiliency of the paperboard. This is effected by a single outward pushing motion by a finger for example on each sidewall. A product, typically, fast food, is placed inside the tray, and top closure 34 swung downwardly to the right, with flaps 38 placed interiorly of the tray. Front lid top flap 40 is bent down, also interiorly of the tray. As shown at FIG. 3, tabs 52 of latching member 50 are folded and bent into latching slot 42 so as to lie interiorly of the tray, as indicated by the dashed lines of FIG. 3. The free end of tongue 46 is covered by flap 50.

Figure 5:
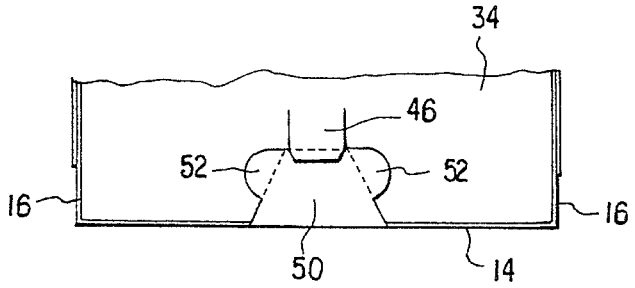
FIG. 5 is a partial view, similar to FIG. 3, and showing an alternative front latching mode.

Alternatively, that portion of flap 50 most remote from panel 14 can be tucked underneath the tip of latching tongue 46, in which case lateral tabs 52 lie exteriorly of the container, on top of top cover 34. This is illustrated at FIG. 5.

Figure 4:
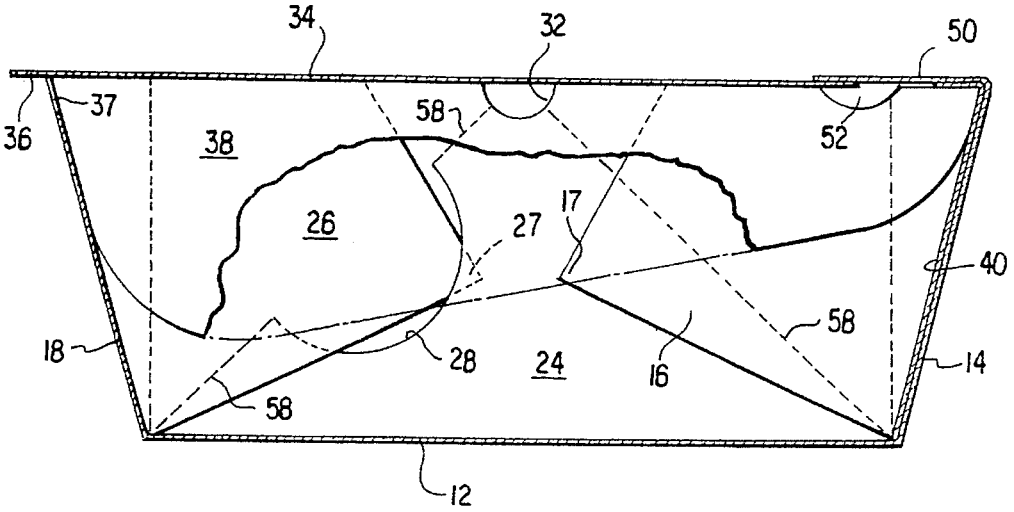
FIG. 4 is a view taken along section 4—4 of FIG. 3.

FIG. 4 also shows the relation between one corner 27 on the exterior of the container. FIG. 4 further shows side flaps 38 on the interior of the carton. However, flaps 38 could be so folded as to lie exteriorly of the carton. Vent opening 37 is formed in the rear wall of the erected container by central cut portion 36.

It will be observed that cuts 28 and tabs 29 may be placed in triangular panels 30, instead of on triangular panels 26 as shown, and that corners 17 of panels 16 may extend through such relocated cuts 28 to rigidly the tray sidewalls upon unfolding and in the same manner.

Geometrical terms of orientation such as horizontal, vertical, upper, and the like are employed to facilitate the description and are not intended to be limiting.

I claim:

1. A unitary blank of paperboard for forming a collapsible tray, said blank including a lower portion and an upper portion, said upper and lower portions being joined together along a hinge line, said lower portion adapted to form a tray, said lower portion including a central, tray bottom forming panel, said bottom forming panel having upper and lower edges each of which is foldably secured to respective lower front and upper rear tray wall forming panels, a lateral panel foldably secured to each of respective left and right edges of said lower tray panel, a lateral panel secured to each of respective left and right edges of said upper tray wall forming panel, a first triangular panel secured to each of respective left and right edges of said central tray bottom forming panel, each of said first triangular panels foldably secured to respective second and third triangular panels, said first triangular panel and said second and third triangular panels adapted to form tray sidewall panels, said tray sidewall panels adapted to be folded to an erected position from a collapsed position, the upper portion of said blank having a top lid forming panel having a latching opening at its upper portion thereof, a latching tongue extending into said latching opening, the lower edge of said lower central tray bottom forming panel hingedly secured to a latching flap, said latching flap having right and left sides and having a tab foldably secured to each respective left and right side.

2. The blank of claim 1 including a cut between respective said first triangular panels and said second triangular panels, said cuts adapted to receive respective portions of respective said lateral flaps.

3. The blank of claim 2 wherein said lower front and upper rear tray wall forming panels are trapezoidal.

4. The blank of claim 1 including a cut between respective said first triangular panels and said third triangular panels, said cuts adapted to receive respective portions of respective said lateral flaps.

5. A collapsible container including a generally rectangular lower tray having rear, front, and side walls, and a generally rectangular top lid closure, said lower tray rear wall having an upper edge, said top lid closure foldably secured to said upper edge of said rear wall, said top tray lid closure having a latching opening therein and a tongue extending into said latching opening, said front wall of said tray having an upper edge, said tray front wall upper edge carrying a latching flap, said latching flap having a pair of laterally extending latching tabs, said side walls of said lower tray having fold lines and being inwardly collapsible towards each other and having means for latching each of said side walls to a substantially planar shape.

6. The container of claim 5 wherein said lower tray is generally truncated.

7. The container of claim 5 wherein said means for latching said side walls to a substantially planar shape includes a latching slit in each said side wall, each said side wall having at least one panel having a latching tip, said panel having said latching tip located interiorly on said side wall, each said tip passing through said latching slit from the interior portion of its respective side wall to the exterior portion of its respective side wall.

8. The container of claim 7 wherein each said slit is arcuate.

* * * * *